US007367899B2

(12) United States Patent
Rice et al.

(10) Patent No.: US 7,367,899 B2
(45) Date of Patent: May 6, 2008

(54) METAL WOOD CLUB WITH IMPROVED HITTING FACE

(75) Inventors: Scott A. Rice, San Diego, CA (US); Nicholas M. Nardacci, Bristol, RI (US); Raymond L. Poynor, Las Vegas, NV (US)

(73) Assignee: Acushnet Company, Fairhaven, MA (US)

( * ) Notice: Subject to any disclaimer, the term of this patent is extended or adjusted under 35 U.S.C. 154(b) by 298 days.

(21) Appl. No.: 11/105,243

(22) Filed: Apr. 13, 2005

(65) Prior Publication Data

US 2005/0187034 A1 Aug. 25, 2005

Related U.S. Application Data

(63) Continuation-in-part of application No. 10/911,341, filed on Aug. 4, 2004, now Pat. No. 7,207,898, which is a continuation-in-part of application No. 10/428,061, filed on May 1, 2003, now Pat. No. 7,029,403, which is a continuation-in-part of application No. 09/551,771, filed on Apr. 18, 2000, now Pat. No. 6,605,007.

(51) Int. Cl.
*A63B 53/04* (2006.01)

(52) U.S. Cl. ..... 473/329; 473/345; 473/346; 473/349

(58) Field of Classification Search ..... 473/324–350, 473/287–292, 219–256
See application file for complete search history.

(56) References Cited

U.S. PATENT DOCUMENTS 1,318,325 A 10/1919 Klin
1,319,233 A 10/1919 Mattern
1,467,435 A 9/1923 Kinnear
1,525,352 A 2/1925 Aitken
1,543,691 A 6/1925 Beat
1,582,836 A 4/1926 Link
1,589,363 A 6/1926 Butchart
1,595,589 A 8/1926 Tyler
1,605,551 A 11/1926 Mattern
1,699,874 A 1/1929 Buhrke
1,704,119 A 3/1929 Buhrke
1,704,165 A 3/1929 Buhrke
1,720,867 A 7/1929 Webster et al.
2,034,936 A 3/1936 Barnhart
2,087,685 A 7/1937 Hackney
3,567,228 A 3/1971 Lynn
3,571,900 A 3/1971 Hardesty (Continued)

FOREIGN PATENT DOCUMENTS

CN 1114911 1/1996

(Continued)

*Primary Examiner*—Sebastiano Passaniti
(74) *Attorney, Agent, or Firm*—Kristin D. Wheeler

(57) ABSTRACT

A hitting face of a golf club head having improved strength properties. In one embodiment, the hitting face is made from multiple materials. The multiple materials form layers of a laminate construction of a flat portion of a hitting face insert. The layers of the laminate are joined together using a diffusion bonding technique. Preferably, at least one layer of the laminate is a thin layer of a very strong material that forms the rear side of the hitting face insert so as to prevent failure of the hitting face insert on that rear side due to repeated impacts with golf balls.

15 Claims, 4 Drawing Sheets

U.S. PATENT DOCUMENTS

| | | | | |
|---|---|---|---|---|
| 3,625,518 | A | | 12/1971 | Solheim |
| 3,659,855 | A | | 5/1972 | Hardesty |
| 3,695,618 | A | * | 10/1972 | Woolley et al. ..... 473/342 |
| 3,863,932 | A | | 2/1975 | Lezatte |
| 3,985,363 | A | | 10/1976 | Jepson et al. |
| 4,023,802 | A | | 5/1977 | Jepson et al. |
| 4,193,601 | A | | 3/1980 | Reid, Jr. et al. |
| 4,213,613 | A | | 7/1980 | Nygren |
| 4,214,754 | A | | 7/1980 | Zebelean |
| D267,965 | S | | 2/1983 | Kobayashi |
| 4,429,879 | A | | 2/1984 | Schmidt |
| 4,449,707 | A | | 5/1984 | Hayashi et al. |
| 4,451,041 | A | | 5/1984 | Hayashi et al. |
| 4,451,042 | A | | 5/1984 | Hayashi et al. |
| 4,465,221 | A | | 8/1984 | Schmidt |
| 4,471,961 | A | | 9/1984 | Masghati et al. |
| 4,489,945 | A | | 12/1984 | Kobayashi |
| 4,511,145 | A | | 4/1985 | Schmidt |
| 4,762,324 | A | | 8/1988 | Anderson |
| 4,792,140 | A | | 12/1988 | Yamaguchi et al. |
| 4,804,188 | A | * | 2/1989 | McKee et al. ..... 473/342 |
| 4,826,172 | A | | 5/1989 | Antonious |
| 4,842,243 | A | | 6/1989 | Butler |
| 4,913,438 | A | | 4/1990 | Anderson |
| 4,915,385 | A | | 4/1990 | Anderson |
| 4,915,386 | A | | 4/1990 | Antonious |
| 4,919,430 | A | | 4/1990 | Antonious |
| 4,919,431 | A | | 4/1990 | Antonious |
| 4,921,252 | A | | 5/1990 | Antonious |
| 4,928,965 | A | | 5/1990 | Yamaguchi et al. |
| 4,930,781 | A | | 6/1990 | Allen |
| 4,932,658 | A | | 6/1990 | Antonious |
| 4,955,610 | A | | 9/1990 | Creighton et al. |
| D312,858 | S | | 12/1990 | Anderson et al. |
| 5,000,454 | A | | 3/1991 | Soda |
| 5,024,437 | A | | 6/1991 | Anderson |
| 5,028,049 | A | | 7/1991 | McKeighen |
| 5,046,733 | A | | 9/1991 | Antonious |
| 5,056,705 | A | | 10/1991 | Wakita et al. |
| 5,060,951 | A | | 10/1991 | Allen |
| 5,067,715 | A | | 11/1991 | Schmidt et al. |
| 5,090,702 | A | | 2/1992 | Viste |
| 5,094,383 | A | | 3/1992 | Anderson et al. |
| 5,106,094 | A | | 4/1992 | Desbiolles et al. |
| 5,141,230 | A | | 8/1992 | Antonious |
| 5,163,682 | A | | 11/1992 | Schmidt et al. |
| 5,180,166 | A | | 1/1993 | Schmidt et al. |
| 5,183,255 | A | | 2/1993 | Antonious |
| 5,213,328 | A | | 5/1993 | Long et al. |
| 5,221,087 | A | | 6/1993 | Fenton et al. |
| 5,240,252 | A | | 8/1993 | Schmidt et al. |
| 5,242,167 | A | | 9/1993 | Antonious |
| 5,255,918 | A | | 10/1993 | Anderson et al. |
| 5,261,663 | A | | 11/1993 | Anderson |
| 5,261,664 | A | | 11/1993 | Anderson |
| 5,271,621 | A | | 12/1993 | Lo |
| 5,292,129 | A | | 3/1994 | Long et al. |
| 5,295,689 | A | | 3/1994 | Lundberg |
| 5,301,945 | A | | 4/1994 | Schmidt et al. |
| 5,318,300 | A | | 6/1994 | Schmidt et al. |
| 5,328,184 | A | | 7/1994 | Antonious |
| 5,344,140 | A | | 9/1994 | Anderson |
| 5,346,216 | A | * | 9/1994 | Aizawa ..... 473/329 |
| 5,346,218 | A | | 9/1994 | Wyte |
| 5,351,958 | A | | 10/1994 | Helmstetter |
| 5,358,249 | A | | 10/1994 | Mendralla |
| 5,362,047 | A | | 11/1994 | Shaw et al. |
| 5,362,055 | A | | 11/1994 | Rennie |
| 5,366,223 | A | | 11/1994 | Werner et al. |
| 5,380,010 | A | | 1/1995 | Werner et al. |
| 5,390,924 | A | | 2/1995 | Antonious |
| 5,395,113 | A | | 3/1995 | Antonious |
| 5,397,126 | A | | 3/1995 | Allen |
| 5,401,021 | A | | 3/1995 | Allen |
| 5,405,136 | A | | 4/1995 | Hardman |
| 5,405,137 | A | | 4/1995 | Vincent et al. |
| 5,407,202 | A | | 4/1995 | Igarashi |
| RE34,925 | E | | 5/1995 | McKeighen |
| 5,417,419 | A | | 5/1995 | Anderson et al. |
| 5,417,559 | A | | 5/1995 | Schmidt |
| 5,423,535 | A | | 6/1995 | Shaw et al. |
| 5,429,357 | A | | 7/1995 | Kobayashi |
| 5,431,396 | A | | 7/1995 | Shieh |
| 5,433,440 | A | | 7/1995 | Lin |
| 5,447,307 | A | | 9/1995 | Antonious |
| 5,447,309 | A | | 9/1995 | Vincent |
| 5,451,056 | A | | 9/1995 | Manning |
| 5,460,376 | A | | 10/1995 | Schmidt et al. |
| 5,467,983 | A | | 11/1995 | Chen |
| 5,470,069 | A | | 11/1995 | Schmidt et al. |
| 5,474,296 | A | | 12/1995 | Schmidt et al. |
| 5,482,279 | A | | 1/1996 | Antonious |
| 5,497,993 | A | | 3/1996 | Shan |
| 5,505,453 | A | | 4/1996 | Mack |
| 5,522,593 | A | | 6/1996 | Kobayashi et al. |
| 5,524,331 | A | | 6/1996 | Pond |
| 5,533,729 | A | | 7/1996 | Leu |
| 5,536,006 | A | | 7/1996 | Shieh |
| 5,547,630 | A | | 8/1996 | Schmidt |
| 5,549,297 | A | | 8/1996 | Mahaffey |
| 5,564,994 | A | | 10/1996 | Chang |
| 5,584,770 | A | | 12/1996 | Jensen |
| 5,595,552 | A | | 1/1997 | Wright et al. |
| 5,611,741 | A | | 3/1997 | Schmidt et al. |
| 5,611,742 | A | | 3/1997 | Kobayashi |
| D379,393 | S | | 5/1997 | Kubica et al. |
| 5,626,530 | A | | 5/1997 | Schmidt et al. |
| 5,643,104 | A | | 7/1997 | Antonious |
| 5,643,108 | A | | 7/1997 | Cheng |
| 5,643,110 | A | | 7/1997 | Igarashi |
| 5,649,872 | A | | 7/1997 | Antonious |
| 5,651,409 | A | | 7/1997 | Sheehan |
| 5,655,976 | A | | 8/1997 | Rife |
| 5,669,827 | A | | 9/1997 | Nagamoto |
| 5,669,829 | A | | 9/1997 | Lin |
| 5,674,132 | A | | 10/1997 | Fisher |
| D387,113 | S | | 12/1997 | Burrows |
| 5,695,411 | A | | 12/1997 | Wright et al. |
| 5,697,855 | A | * | 12/1997 | Aizawa ..... 473/350 |
| 5,709,614 | A | | 1/1998 | Horiba |
| 5,709,615 | A | | 1/1998 | Liang |
| 5,711,722 | A | | 1/1998 | Miyajima et al. |
| 5,716,292 | A | | 2/1998 | Huang |
| 5,718,641 | A | | 2/1998 | Lin |
| 5,720,673 | A | | 2/1998 | Anderson |
| 5,743,813 | A | | 4/1998 | Chen et al. |
| 5,753,170 | A | | 5/1998 | Muang |
| 5,755,624 | A | | 5/1998 | Helmstetter |
| 5,762,567 | A | | 6/1998 | Antonious |
| 5,766,092 | A | | 6/1998 | Mimeur et al. |
| 5,766,094 | A | | 6/1998 | Mahaffey et al. |
| 5,766,095 | A | | 6/1998 | Antonious |
| 5,776,011 | A | | 7/1998 | Su et al. |
| 5,807,190 | A | | 9/1998 | Krumme et al. |
| 5,827,131 | A | * | 10/1998 | Mahaffey et al. ..... 473/342 |
| 5,827,132 | A | | 10/1998 | Bamber |
| RE35,955 | E | | 11/1998 | Lu |
| D401,652 | S | | 11/1998 | Burrows |
| 5,830,084 | A | | 11/1998 | Kosmatka |
| 5,839,975 | A | | 11/1998 | Lundberg |
| 5,842,934 | A | | 12/1998 | Ezaki et al. |
| 5,851,159 | A | | 12/1998 | Burrows |
| 5,863,261 | A | | 1/1999 | Eggiman |
| 5,873,791 | A | | 2/1999 | Allen |

| | | | | | |
|---|---|---|---|---|---|
| 5,873,795 | A | | 2/1999 | Wozny et al. | |
| D406,294 | S | | 3/1999 | Burrows | |
| 5,888,148 | A | | 3/1999 | Allen | |
| 5,890,973 | A | | 4/1999 | Gamble | |
| D411,272 | S | | 6/1999 | Burrows | |
| 5,908,357 | A | | 6/1999 | Hsieh | |
| 5,921,872 | A | | 7/1999 | Kobayashi | |
| 5,931,746 | A | | 8/1999 | Soong | |
| 5,935,019 | A | | 8/1999 | Yamamoto | |
| 5,938,541 | A | | 8/1999 | Allen et al. | |
| 5,944,619 | A | | 8/1999 | Cameron | |
| 5,954,596 | A | | 9/1999 | Noble et al. | |
| D415,807 | S | | 10/1999 | Werner et al. | |
| 5,961,394 | A | | 10/1999 | Minabe | |
| 5,967,903 | A | * | 10/1999 | Cheng | 473/342 |
| 5,967,905 | A | | 10/1999 | Nakahara et al. | |
| 5,971,868 | A | | 10/1999 | Kosmatka | |
| 5,993,329 | A | | 11/1999 | Shich | |
| 5,993,331 | A | * | 11/1999 | Shieh | 473/342 |
| 6,007,432 | A | | 12/1999 | Kosmatka | |
| 6,027,416 | A | | 2/2000 | Schmidt et al. | |
| 6,099,414 | A | * | 8/2000 | Kusano et al. | 473/342 |
| 6,139,445 | A | | 10/2000 | Werner et al. | |
| 6,143,169 | A | | 11/2000 | Lee | |
| 6,152,833 | A | | 11/2000 | Werner et al. | |
| 6,165,081 | A | * | 12/2000 | Chou | 473/329 |
| 6,183,381 | B1 | * | 2/2001 | Grant et al. | 473/342 |
| 6,248,025 | B1 | | 6/2001 | Murphy | |
| 6,319,150 | B1 | | 11/2001 | Werner et al. | |
| 6,338,683 | B1 | | 1/2002 | Kosmatka | |
| 6,354,962 | B1 | | 3/2002 | Galloway | |
| 6,368,234 | B1 | | 4/2002 | Galloway | |
| 6,381,828 | B1 | | 5/2002 | Boyce | |
| 6,398,666 | B1 | | 6/2002 | Evans et al. | |
| 6,435,982 | B1 | | 8/2002 | Galloway et al. | |
| 6,506,129 | B2 | * | 1/2003 | Chen | 473/329 |
| 6,605,007 | B1 | | 8/2003 | Bissonnette et al. | |
| 6,695,715 | B1 | * | 2/2004 | Chikaraishi | 473/329 |
| 6,743,117 | B2 | * | 6/2004 | Gilbert | 473/332 |
| 6,755,627 | B2 | | 6/2004 | Chang | |
| 6,986,715 | B2 | * | 1/2006 | Mahaffey | 473/305 |
| 7,192,364 | B2 | * | 3/2007 | Long | 473/329 |
| 2003/0207726 | A1 | * | 11/2003 | Lee | 473/342 |
| 2004/0209704 | A1 | | 10/2004 | Mahaffey | |

FOREIGN PATENT DOCUMENTS

| | | | |
|---|---|---|---|
| GB | 2268693 | A | 1/1994 |
| GB | 2331938 | A | 6/1999 |
| JP | 59207169 | | 11/1984 |
| JP | 61033682 | | 2/1986 |
| JP | 61162967 | | 7/1986 |
| JP | 61181477 | | 8/1986 |
| JP | 61185281 | | 8/1986 |
| JP | 61240977 | | 10/1986 |
| JP | 1244770 | | 9/1989 |
| JP | 02130519 | | 5/1990 |
| JP | 4020357 | | 1/1992 |
| JP | 4327864 | | 11/1992 |
| JP | 5212526 | | 8/1993 |
| JP | 05237207 | | 9/1993 |
| JP | 6007487 | | 1/1994 |
| JP | 06031016 | | 2/1994 |
| JP | 6114126 | | 4/1994 |
| JP | 6126002 | | 5/1994 |
| JP | 6154367 | | 6/1994 |
| JP | 6182005 | | 7/1994 |
| JP | 6269518 | | 9/1994 |
| JP | 8168541 | | 7/1996 |
| JP | 8243194 | | 9/1996 |
| JP | 8280853 | | 10/1996 |
| JP | 8280854 | | 10/1996 |
| JP | 8294550 | | 11/1996 |
| JP | 9028842 | | 2/1997 |
| JP | 9047531 | | 2/1997 |
| JP | 9154985 | | 6/1997 |
| JP | 9168613 | | 6/1997 |
| JP | 9192270 | | 7/1997 |
| JP | 9192273 | | 7/1997 |
| JP | 9239074 | | 9/1997 |
| JP | 9239075 | | 9/1997 |
| JP | 9248353 | | 9/1997 |
| JP | 9294833 | | 11/1997 |
| JP | 9299519 | | 11/1997 |
| JP | 10024126 | | 1/1998 |
| JP | 10024128 | | 1/1998 |
| JP | 10085369 | | 4/1998 |
| JP | 10118227 | | 5/1998 |
| JP | 10137372 | | 5/1998 |
| JP | 10155943 | | 6/1998 |
| JP | 10258142 | | 9/1998 |
| JP | 10263121 | | 10/1998 |
| JP | 10323410 | | 12/1998 |
| JP | 10337347 | | 12/1998 |

* cited by examiner

METAL WOOD CLUB WITH IMPROVED HITTING FACE

CROSS-REFERENCE TO RELATED APPLICATION

The present application is a continuation-in-part of U.S. patent application Ser. No. 10/911,341 filed on Aug. 4, 2004, now U.S. Pat. No. 7,207,898 which is a continuation-in-part of U.S. patent application Ser. No. 10/428,061 filed on May 1, 2003, now U.S. Pat. No. 7,029,403 which is a continuation-in part of 09/551,771, filed Apr. 18, 2000, now U.S. Pat. No. 6,605,007 the disclosures of which are incorporated herein in their entireties by reference.

FIELD OF THE INVENTION

The present invention relates to an improved golf club head. More particularly, the present invention relates to a golf club head with an improved striking face having improved strength and launch characteristics.

BACKGROUND

The complexities of golf club design are known. The specifications for each component of the club (i.e., the club head, shaft, grip, and subcomponents thereof) directly impact the performance of the club. Thus, by varying the design specifications, a golf club can be tailored to have specific performance characteristics.

The design of club heads has long been studied. Among the more prominent considerations in club head design are loft, lie, face angle, horizontal face bulge, vertical face roll, center of gravity, inertia, material selection, and overall head weight. While this basic set of criteria is generally the focus of golf club designers, several other design aspects must also be addressed. The interior design of the club head may be tailored to achieve particular characteristics, such as the inclusion of hosel or shaft attachment means, perimeter weights on the club head, and fillers within the hollow club heads.

Golf club heads must also be strong to withstand the repeated impacts that occur during collisions between the golf club and the golf balls. The loading that occurs during this transient event can create a peak force of over 2,000 lbs. Thus, a major challenge is designing the club face and body to resist permanent deformation or failure by material yield or fracture. Conventional hollow metal wood drivers made from titanium typically have a uniform face thickness exceeding 2.5 mm to ensure structural integrity of the club head.

Players generally seek a metal wood driver and golf ball combination that delivers maximum distance and landing accuracy. The distance a ball travels after impact is dictated by the magnitude and direction of the ball's initial velocity and the ball's rotational velocity or spin. Environmental conditions, including atmospheric pressure, humidity, temperature, and wind speed, further influence the ball's flight. However, these environmental effects are beyond the control of the golf equipment designers. Golf ball landing accuracy is driven by a number of factors as well. Some of these factors are attributed to club head design, such as center of gravity and club face flexibility.

The United States Golf Association (USGA), the governing body for the rules of golf in the United States, has specifications for the performance of golf balls. These performance specifications dictate the size and weight of a conforming golf ball. One USGA rule limits the golf ball's initial velocity after a prescribed impact to 250 feet per second±2% (or 255 feet per second maximum initial velocity). To achieve greater golf ball travel distance, ball velocity after impact and the coefficient of restitution of the ball-club impact must be maximized while remaining within this rule.

Generally, golf ball travel distance is a function of the total kinetic energy imparted to the ball during impact with the club head, neglecting environmental effects. During impact, kinetic energy is transferred from the club and stored as elastic strain energy in the club head and as viscoelastic strain energy in the ball. After impact, the stored energy in the ball and in the club is transformed back into kinetic energy in the form of translational and rotational velocity of the ball, as well as the club. Since the collision is not perfectly elastic, a portion of energy is dissipated in club head vibration and in viscoelastic relaxation of the ball. Viscoelastic relaxation is a material property of the polymeric materials used in all manufactured golf balls.

Viscoelastic relaxation of the ball is a parasitic energy source, which is dependent upon the rate of deformation. To minimize this effect, the rate of deformation should be reduced. This may be accomplished by allowing more club face deformation during impact. Since metallic deformation may be substantially elastic, the strain energy stored in the club face is returned to the ball after impact thereby increasing the ball's outbound velocity after impact. Therefore, there remains a need in the art to improve the elastic behavior of the hitting face.

As discussed in commonly-owned parent patent U.S. Pat. No. 6,605,007, the disclosure of which is incorporated herein in its entirety, one way known in the art to obtain the benefits of titanium alloys in the hitting face is to use a laminate construction for the face insert. Laminated inserts for golf club heads are well-known in the art, where multiple metal layers of varying density are joined together to maximize the strength and flexural properties of the insert. The method used to join the layers together are critical to the life of the insert, as the repeated impacts with golf balls can eventually cause the insert to delaminate. In the art, laminated striking plate inserts for golf clubs, the bonding strength of the laminate is usually quite low, generally lower than the yield strength of the weakest material. As such, there remains a need in the art for additional techniques for effectively bonding together the layers of a laminate hitting face, particularly where all layers of the hitting face are titanium alloys.

SUMMARY OF THE INVENTION

A golf club head includes a hitting face having a first layer of a first material having a first thickness and a second layer of a second material having a second thickness. The second thickness is less than the first thickness, and the second material has a higher tensile strength than the first material. In one embodiment, the first material is more ductile and is positioned to impact the ball. In another embodiment, the layers are bonded by diffusion bonding.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE PREFERRED EMBODIMENT

The '007 patent, previously incorporated by reference, discloses an improved golf club that also produces a relatively large "sweet zone" or zone of substantially uniform high initial velocity or high coefficient of restitution (COR).

COR or coefficient of restitution is a measure of collision efficiency. COR is the ratio of the velocity of separation to the velocity of approach. In this model, therefore, COR was determined using the following formula:

$$(v_{club\text{-}post}-v_{ball\text{-}post})/(v_{ball\text{-}pre}-v_{club\text{-}pre})$$

where, $v_{club\text{-}post}$ represents the velocity of the club after impact;

$v_{ball\text{-}post}$ represents the velocity of the ball after impact;

$v_{club\text{-}pre}$ represents the velocity of the club before impact (a value of zero for USGA COR conditions); and $v_{ball\text{-}pre}$ represents the velocity of the ball before impact.

COR, in general, depends on the shape and material properties of the colliding bodies. A perfectly elastic impact has a COR of one (1.0), indicating that no energy is lost, while a perfectly inelastic or perfectly plastic impact has a COR of zero (0.0), indicating that the colliding bodies did not separate after impact resulting in a maximum loss of energy. Consequently, high COR values are indicative of greater ball velocity and distance.

A variety of techniques may be utilized to vary the deformation of the club face to manipulate the size and location of the sweet spot, including uniform face thinning, thinned faces with ribbed stiffeners and varying thickness, among others. These designs should have sufficient structural integrity to withstand repeated impacts without permanently deforming the club face, as the backside portion of a metal wood face is very sensitive to the high impact stress conditions due to manipulations to achieve a COR value at the allowable USGA limit. In general, conventional club heads also exhibit wide variations in initial ball speed after impact, depending on the impact location on the face of the club.

Figure 1:
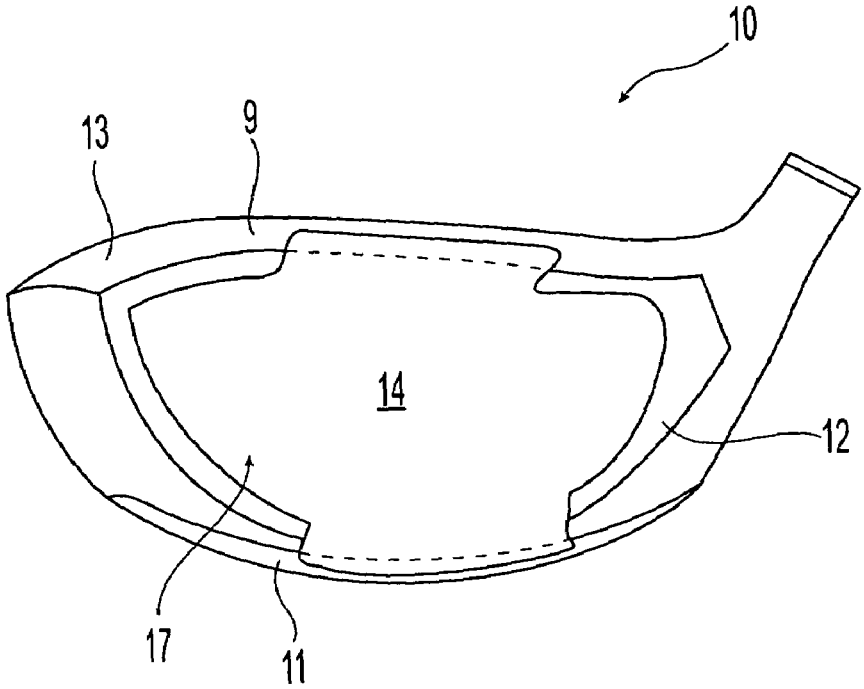
FIG. 1 is a front view of a metal wood club head having a hitting face insert according to one embodiment of the present invention.

FIG. 1 shows a metal wood club head 10. A body 13 having a crown 9, a hitting face 12 and a sole 11 is preferably a hollow shell made of a strong and resilient metal, such as steel or titanium. Body 13 may be made by any method known in the art, such as by casting or forging. Body 13 may be any size appropriate in the art for metal wood clubs, but preferably includes a large internal cavity that is greater than 250 cubic centimeters. The internal cavity (not shown) may be filled with a low density material such as foam, but the internal cavity is preferably empty.

Figure 2:
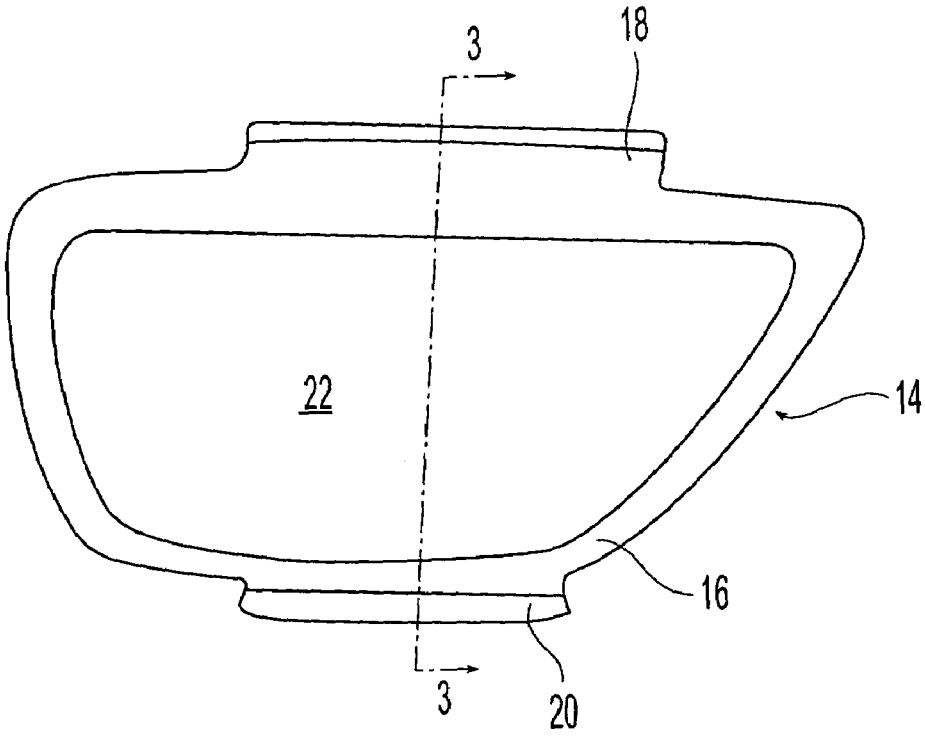
FIG. 2 is a planar view of the rear face of the hitting face insert of FIG. 1.

Similar to many metal wood club head configurations in the art, club head 10 includes a hitting face 12 that includes an opening into which a face insert 14 is affixed. As shown in FIG. 2, face insert 14 includes a relatively flat portion 16 that forms the main portion of face insert 14 and two optional wings 18, 20. Face insert 14 is affixed to hitting face 12 by any method known in the art, preferably welding. Wings 18, 20 remove the weld lines away from hitting face 12 caused by affixing face insert 14 thereto, i.e., to upper and lower portions of body 13. The discontinuities of material properties associated with welding are removed from hitting face 12.

Figure 3:
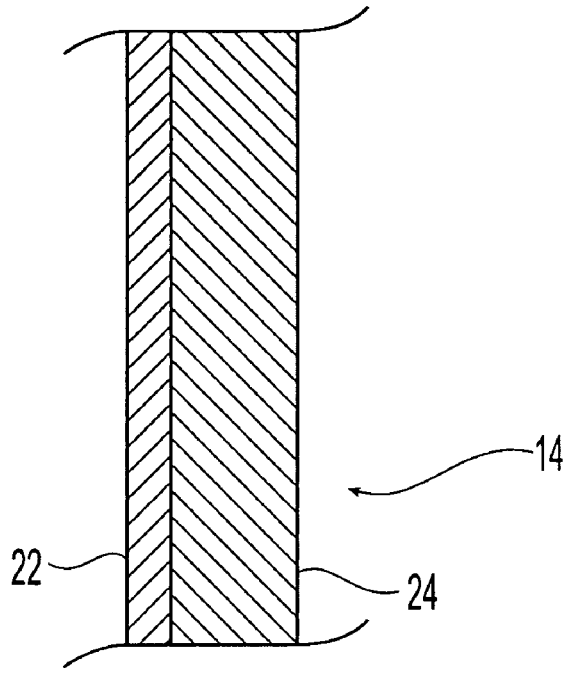
FIG. 3 is an enlarged, partial cross-sectional view of the hitting face insert taken along line 3-3 in FIG. 2.

Face insert 14 is preferably made of a strong and resilient metal material. Flat portion 16 of face insert 14 has a laminate construction, where at least two layers of material are joined together to form a single plate-like piece. The laminate may be formed from as many individual layers as necessary to obtain the desire combination of ductility and strength, however, preferably face insert 14 includes at least two layers, a thin layer 22 and a thick layer 24, where thin layer 22 is a different material or has different material properties from thick layer 24. As shown in FIGS. 2 and 3, thin layer 22 preferably covers the entire rear side 15 of flat portion 16 of hitting face 14. The front side 17 of flat portion 16 of hitting face 14 is preferably made of the material of thick layer 24. Wings 16, 18 are preferably not made of laminated materials, but are purely the material of thick layer 24.

Thick layer 24, or the striking surface of hitting face 14, is preferably made of a metal material that is ductile and tough, such as a titanium alloy like SP700, but may be any appropriate material known in the art such as other titanium alloys and metals. Thick layer 24 provides the flexibility and stiffness properties of hitting face 14, such that a high COR may be achieved. As the thickness of thick layer 24 is preferably substantially greater than the thickness of thin layer 22, these flexibility properties will dominate the deflection of hitting face 14 during impact with a golf ball. The thickness of thick layer 24 is preferably minimized to save weight, thereby providing greater control over the mass distribution properties of club head 10. The actual thickness of thick layer 24 varies from club to club.

Thin layer 22 is preferably made of a thin layer of a very strong material, such as beta titanium alloys like 10-2-3. The additional strength provided by thin layer 22 allows for the thickness of thick layer 24 to be further minimized, as the inclusion of thin layer 22 makes hitting face insert 14 less susceptible to yielding under severe impact conditions. As strong materials tend to be less ductile than similar but weaker materials, thin layer 22 is preferably very thin compared to thick layer 24 so that the flexibility properties of the material of thin layer 22 are dominated by the flexibility properties of thick layer 24. However, the strength of the material of thin layer 22 is locally added to rear side 15 of flat portion 16 of hitting face 14 so that cracks are less likely to develop on rear side 15. In a preferred embodiment, layer 24 is positioned to impact the balls.

Figure 4:
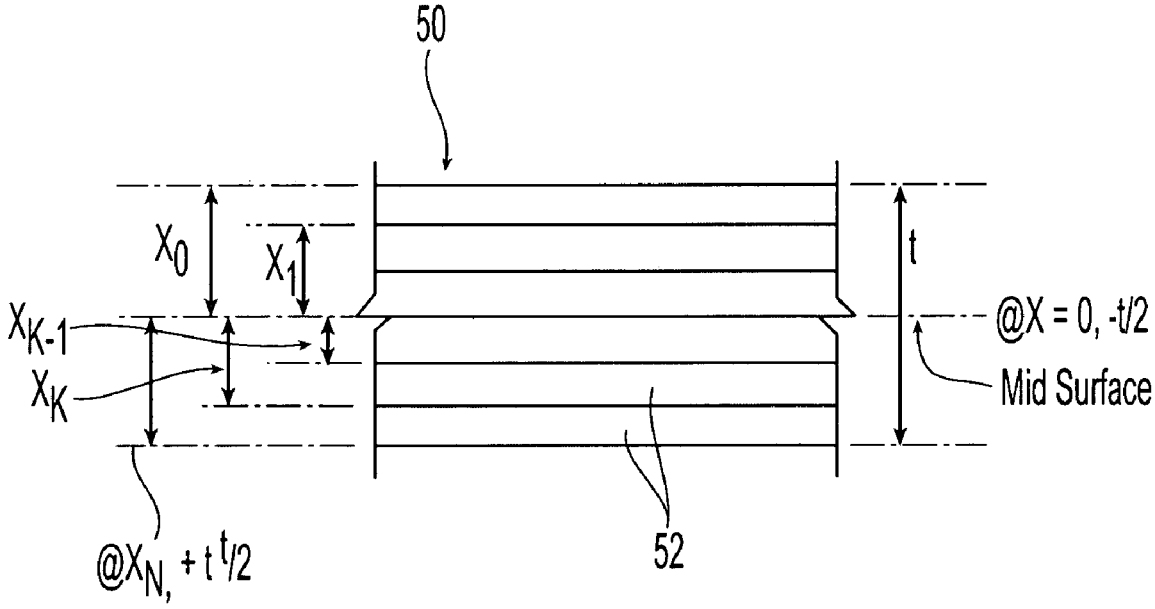
FIG. 4 is a cross-sectional view of a laminate structure which corresponds to FIG. 14 of the parent patent.

As discussed in the parent '007 patent and the parent '314 application, previously incorporated by reference, a useful measurement of the varying flexibilities in a hitting face is to calculate flexural stiffness. Calculation of flexural stiffness for asymmetric shell structures with respect to the mid-surface is common in composite structures where laminate shell theory is applicable. Here the Kirchoff shell assumptions are applicable. Referring to FIG. 4, which is FIG. 14 from the '007 patent, an asymmetric isotropic laminate 50 is shown with N lamina or layers 52. Furthermore, the laminate is described to be of thickness, t, with $x_i$ being directed distances or coordinates in accordance with FIG. 4. The positive direction is defined to be downward and the laminate points $x_i$ defining the directed distance to the bottom of the $k^{th}$ laminate layer. For example, $x_0=-t/2$ and $x_N=+t/2$ for a laminate of thickness t made comprised of N layers.

Further complexity is added if the lamina can be constructed of multiple materials, M. In this case, the area percentage, $A_i$ is included in the flexural stiffness calculation, as before in a separate summation over the lamina. The most general form of computing the flexural stiffness in this situation is, as stated above:

$$FS_z = \sum_{i=1}^{n} \frac{A_i}{\sum_{j=1}^{n} A_j} E_i I_i^3$$

Due to the geometric construction of the lamina about the mid-surface, asymmetry results, i.e., the laminate lacks material symmetry about the mid-surface of the laminate. However, this asymmetry does not change the calculated values for the flexural stiffness only the resulting forces and moments in the laminate structure under applied loads. An example of this type of construction would be a titanium alloy face of uniform thickness and first modulus $E_t$, where the central zone is backed by a steel member of width half the thickness of the titanium portion, and having second modulus $E_s$. In this example, the flexural stiffness can be approximated by the simplified equation, as follows:

$$FS_z = \frac{1}{3}\sum_{i=1}^{M} [E(x_k^3 - x_{k-1}^3)]_i$$

$$FS_z = \tfrac{1}{3}\{[E_s(x_o^3 - x_1^3)] + E_t(x_1^3 - x_2^3)]\}$$

here, $x_o=-t/2$, $x_1=t/2-WI$ and $x_2=t/2$, substitution yielding $$FS_z = \tfrac{1}{3}\{[E_s((-t/2)^3 - (t/2-WI)^3)] + E_t((t/2-WI)^3 - (t/2)^3)]\}$$

If t=0.125, then WI=0.083 and FS of this zone is 3,745 lb·in, where the thickness of the steel layer is about one-half of the thickness of the titanium layer.

Figure 5:
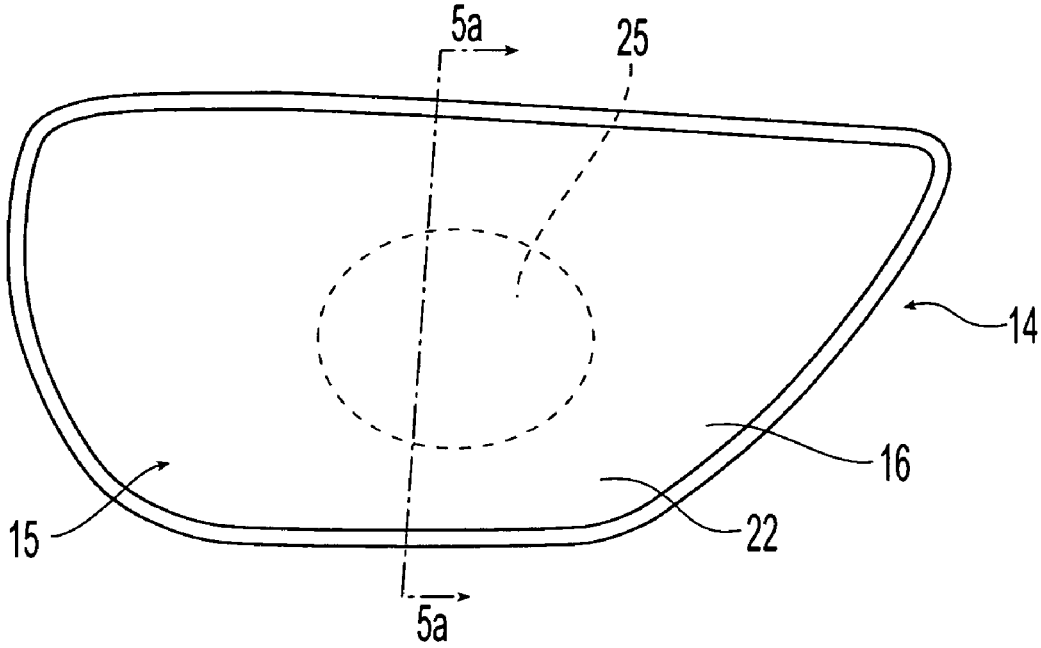
FIG. 5 is a planar view of the rear face of another embodiment of a hitting face insert according to the present invention.
Figure 5A:
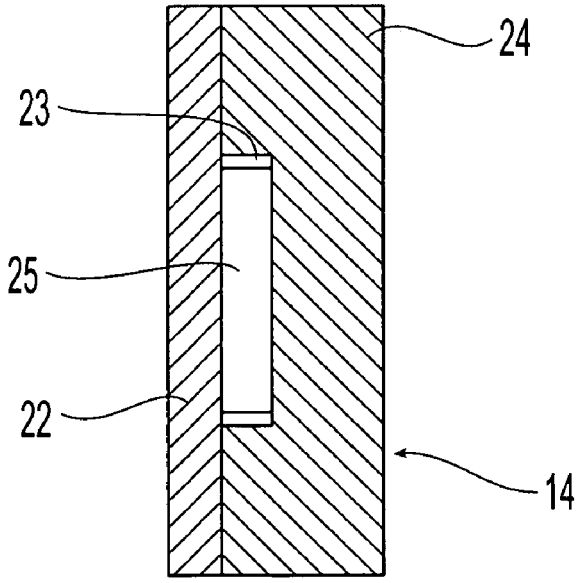
FIG. 5A is an enlarged cross-sectional view of the hitting face insert of FIG. 5 taken along line 5A-5A thereof.

Similar to the zone-based hitting face structure of the parent '007 patent and the parent '314 application, thick layer 24 may be further divided into additional layers so as to obtain the benefits of additional materials. As shown in FIGS. 5 and 5A, a third layer 25 may be included to affect the flexural properties of hitting face 14 locally. In this embodiment, similar to the hitting face insert dense insert discussed in commonly-owned, co-pending U.S. patent application Ser. No. 10/911,422 filed on Aug. 4, 2004, the disclosure of which is incorporated herein by reference, third layer 25 is made of a stiff material. Third layer 25 is preferably a single piece of material with a surface area that is smaller than thick layer 24 such that third layer 25 defines the desired sweet spot. As such, third layer 25 causes the sweet spot to tend to deflect as a single piece. In other words, third layer 25 creates a trampoline-like effect. Third layer 25 may be any shape known in the art, including but not limited to circular, elliptical, or polygonal. Third layer 25 may be inserted into a machined slot on the back of thick layer 24 or may simply be affixed thereto. For example, as shown in FIG. 5A, third layer 25 may be a circular dense insert 25 placed a cavity 23 on a rear surface of thick layer 24. Dense insert 25 is then preferably diffusion bonded to thick layer 24 within cavity 23 and to thin layer 22.

The bond holding together layers 22, 24 must be sufficiently strong to prevent the delamination of layers 22, 24 after repeated impacts. While any method known in the art may be used to bond together layers 22, 24, preferably layers 22, 24 are joined together using diffusion bonding. Diffusion bonding is a solid-state joining process involving holding materials together under load conditions at an elevated temperature. The process is typically performed in a sealed protective environment or vacuum. The pressure applied to the materials is typically less than a macrodeformation-causing load, or the load at which structural damage occurs. The temperature of the process is typically 50-80% of the melting temperature of the materials. The materials are held together for a specified duration, which causes the grain structures at the interface between the two materials to intermingle, thereby forming a bond.

For example, two titanium alloys such as a beta titanium alloy to an alpha or alpha-beta titanium alloy are prepared for diffusion bonding. The materials are machined into the shapes of the parts, then the bonding surfaces are thoroughly cleaned, such as with an industrial cleaning solution such as methanol or ultrasonically, in order to remove as many impurities as possible prior to heating and pressurization of the materials. Optionally, the bonding surfaces may also be roughened prior to cleaning, such as with a metal brush, to increase the surface area of the bonding surfaces. The bonding surfaces are brought into contact with one another, and a load is applied thereto, such as by clamping. The joined materials are heated in a furnace while clamped together, for example at temperatures ranging from 600 to 700 degrees centigrade. The furnace environment is preferably a vacuum or otherwise atmospherically controlled. The duration of the heating cycle may vary from approximately ½ hour to more than ten hours. In order to speed up the heating process, a laser may be trained on the interface of the two materials in order to provide spot heating of the interfacial region. As the materials are heated, the atomic crystalline structure of the two materials melds together in the interfacial region. When the joined materials are removed from the furnace and cooled to room temperature, the resulting bond is strong and durable.

Figure 6:
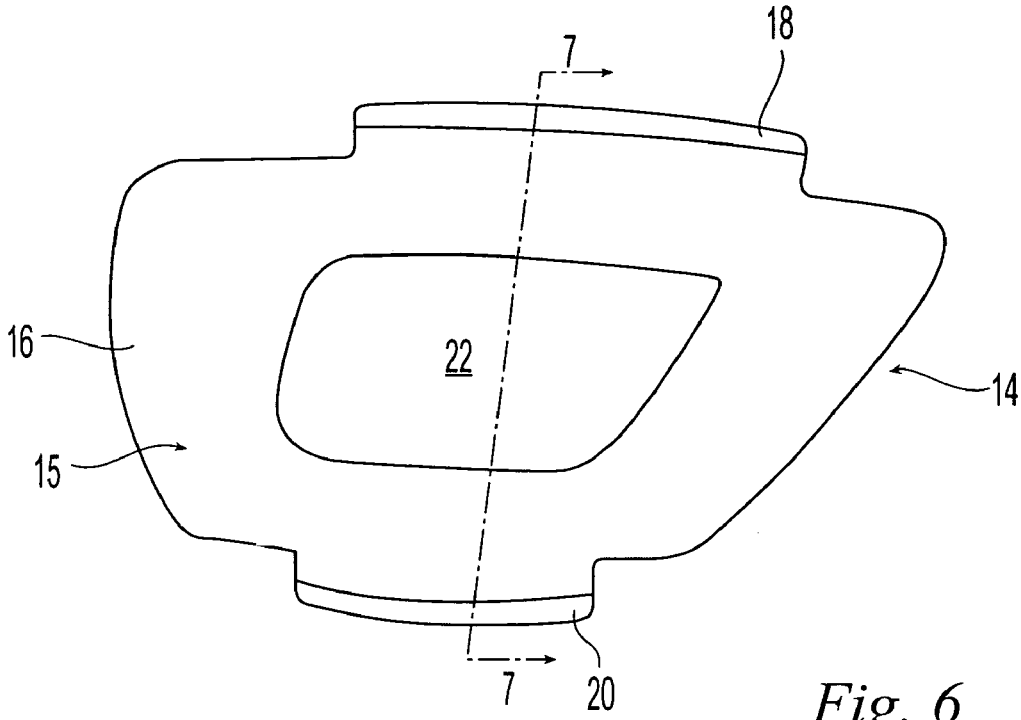
FIG. 6 is a planar view of the rear side of another embodiment of a hitting face insert according to the present invention.
Figure 7:
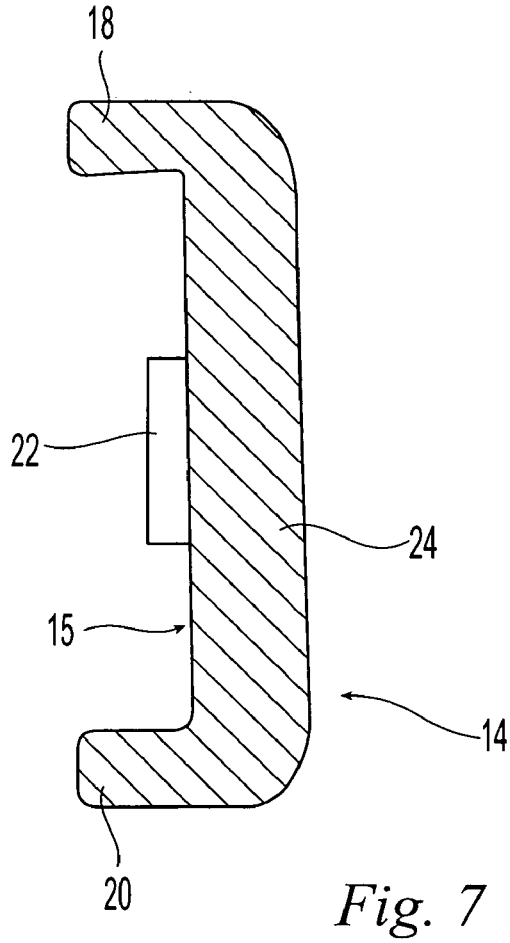
FIG. 7 is an enlarged cross-sectional view of the hitting face insert of FIG. 6.

Other configurations of the laminate structure are also possible. As shown in FIG. 5, the laminate need not be a traditional laminate, where all lamina have similar sizes and shapes. In the present invention, it may be advantageous to include a thick layer 24, as shown in FIG. 6, that forms the majority of the laminate and a thin layer 22 that helps to define areas or zones of hitting face insert 14. For example, thin layer 22 may be used to provide additional stiffness in a particular location, such as the desired location for the sweet spot. Alternatively, thin layer 22 may be used to provide additional strength to a rear side 15 of portion 16 only in the spot of most severe deflection to increase the life of hitting face 14. Similar configurations using multiple materials to define zones having the benefits of material properties such as increased strength and flexibility are shown in the parent patent '007 as well as the parent '314 application, both of which have been previously incorporated by reference.

While various descriptions of the present invention are described above, it should be understood that the various features of each embodiment could be used alone or in any combination thereof. Therefore, this invention is not to be limited to only the specifically preferred embodiments depicted herein. Further, it should be understood that variations and modifications within the spirit and scope of the invention might occur to those skilled in the art to which the invention pertains. For example, additional configurations and placement locations of the thin layer are contemplated. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

We claim:

1. A hollow golf club comprising:

a hollow body defining a cavity, wherein the body is connectable to a shaft; and a hitting face insert configured to be affixed to the body, wherein the hitting face insert comprises a first layer of a first metal material having a substantially constant first thickness, wherein the first layer forms a striking face of the hitting face insert, and a second layer of a second material having a second thickness, wherein the second thickness is less than the first thickness, and the second material has a higher tensile strength than the first material and the second layer covers only a portion of the first layer to define at least one particular zone of the hitting face insert.

2. The golf club head of claim 1 further comprising at least one wing disposed on the hitting face, wherein the wing extends into either a crown or a sole of a club head body.

3. The golf club head of claim 1, wherein the first material has a higher ductility than the second material.

4. The golf club head of claim 1, wherein the second material has a higher yield strength than the first material.

5. The golf club head of claim 1, wherein the first layer is diffusion bonded to the second layer.

6. The golf club head of claim 1, wherein the second layer is provided on the sweet spot.

7. The golf club head of claim 1, wherein the second layer is provided on an area of most severe deflection on the hitting face insert.

8. The golf club head of claim 1, wherein the second layer comprises multiple materials covering multiple zones.

9. The golf club head of claim 1, wherein the first layer is comprised of a SP700 titanium alloy and the second layer is comprised of a beta titanium alloy.

10. The golf club head of claim 1, wherein the second layer is diffusion bonded to the first layer.

11. A hollow golf club head comprising:

a hitting face insert comprising a first layer of a first metal material having a substantially constant first thickness, wherein the first layer forms a striking face of the hitting face insert, a second layer of a second material having a second thickness, and a third layer of a third material having a third thickness, wherein the third layer has a smaller surface area than the first layer and is configured to define a sweet spot on the hitting face, and wherein the second thickness is less than the first thickness.

12. The golf club head of claim 11, wherein a third material flexural stiffness is significantly lower than a first or second layer flexural stiffness.

13. The golf club head of claim 11, wherein a second layer surface area is approximately the same as the first layer surface area.

14. The golf club head of claim 11, wherein the third material is denser than the first and second materials, and wherein the third layer is diffusion bonded to the first layer.

15. The golf club head of claim 11, wherein the third layer is diffusion bonded to at least one of the first or second layers.

* * * * *